US008196668B2

(12) United States Patent
Rytlewski et al.

(10) Patent No.: US 8,196,668 B2
(45) Date of Patent: Jun. 12, 2012

(54) METHOD AND APPARATUS FOR COMPLETING A WELL

(75) Inventors: Gary L. Rytlewski, League City, TX (US); Sidney Jasek, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 817 days.

(21) Appl. No.: 11/640,780

(22) Filed: Dec. 18, 2006

(65) Prior Publication Data

US 2008/0142218 A1 Jun. 19, 2008

(51) Int. Cl.
*E21B 34/10* (2006.01)

(52) U.S. Cl. ..... 166/373; 166/278; 166/227; 166/51

(58) Field of Classification Search ..... 166/278, 166/373, 51, 316, 227
See application file for complete search history.

(56) References Cited

U.S. PATENT DOCUMENTS

| | | | | |
|---|---|---|---|---|
| 3,908,256 | A | 9/1975 | Smith, III | |
| 5,435,393 | A | 7/1995 | Brekke | |
| 5,609,204 | A * | 3/1997 | Rebardi et al. | 166/51 |
| 5,730,223 | A | 3/1998 | Restarick | |
| 5,881,809 | A | 3/1999 | Gillespie | |
| 5,896,928 | A | 4/1999 | Coon | |
| 5,906,238 | A | 5/1999 | Carmody | |
| 5,921,318 | A * | 7/1999 | Ross | 166/250.17 |
| 6,082,454 | A | 7/2000 | Tubel | |
| 6,092,604 | A | 7/2000 | Rice et al. | |
| 6,112,815 | A | 9/2000 | Bode | |
| 6,112,817 | A | 9/2000 | Voll | |
| 6,220,345 | B1 | 4/2001 | Jones et al. | |
| 6,253,851 | B1 | 7/2001 | Schroeder et al. | |
| 6,371,210 | B1 | 4/2002 | Bode | |
| 6,520,254 | B2 | 2/2003 | Hurst et al. | |
| 6,622,794 | B2 | 9/2003 | Zisk | |
| 6,644,412 | B2 * | 11/2003 | Bode et al. | 166/373 |
| 6,715,544 | B2 | 4/2004 | Gillespie et al. | |
| 6,722,440 | B2 * | 4/2004 | Turner et al. | 166/374 |
| 6,749,024 | B2 | 6/2004 | Bixenman | |
| 6,848,510 | B2 | 2/2005 | Bixenman et al. | |
| 6,857,475 | B2 | 2/2005 | Johnson | |
| 6,883,613 | B2 | 4/2005 | Bode | |
| 6,991,030 | B2 | 1/2006 | Setterberg | |

(Continued)

FOREIGN PATENT DOCUMENTS

| | | |
|---|---|---|
| CA | 2483174 | 4/2005 |

(Continued)

OTHER PUBLICATIONS

Brochure entitled, "Sand Control Screen Technologies," Publication No. BOT-08-23062 Baker Hughes Incorporated, Dec. 2008 (12 pages).

*Primary Examiner* — Kenneth L Thompson
*Assistant Examiner* — Blake Michener
(74) *Attorney, Agent, or Firm* — David G. Matthews

(57) ABSTRACT

A technique that is usable with a well includes running screen assemblies into the well on a base pipe. Each screen assembly is associated with a different zone of the well to be gravel packed. During gravel packing of the well, the screen assemblies may be selectively configured to contain pressure without running a tool inside the base pipe to form a fluid seal.

11 Claims, 7 Drawing Sheets

U.S. PATENT DOCUMENTS

| | | | | |
|---|---|---|---|---|
| 7,131,494 | B2 | 11/2006 | Bixenman et al. | |
| 7,222,676 | B2 * | 5/2007 | Patel et al. | 166/378 |
| 7,240,739 | B2 | 7/2007 | Schoonderbeek | |
| 7,249,631 | B2 | 7/2007 | Rouse et al. | |
| 7,296,633 | B2 * | 11/2007 | Bode et al. | 166/386 |
| 2002/0007948 | A1 * | 1/2002 | Bayne et al. | 166/278 |
| 2002/0046834 | A1 * | 4/2002 | Rayssiguier et al. | 166/120 |
| 2002/0046845 | A1 * | 4/2002 | Rayssiguier et al. | 166/375 |
| 2003/0173075 | A1 | 9/2003 | Morvant et al. | |
| 2003/0221829 | A1 * | 12/2003 | Patel et al. | 166/278 |
| 2006/0272814 | A1 | 12/2006 | Broome et al. | |
| 2007/0056724 | A1 | 3/2007 | Spring et al. | |
| 2007/0102153 | A1 | 5/2007 | Bixenman et al. | |

FOREIGN PATENT DOCUMENTS

| | | | |
|---|---|---|---|
| EP | 0295922 | | 12/1988 |
| EP | 1076156 | | 2/2002 |
| GB | 2248465 | | 4/1992 |
| GB | 2376970 | | 12/2002 |
| GB | 2431674 | | 5/2007 |
| GB | 2431943 | | 5/2007 |
| WO | 01/65061 | | 9/2001 |
| WO | 02075110 | A1 | 9/2002 |
| WO | 03023185 | A1 | 3/2003 |
| WO | 2004018839 | A2 | 3/2004 |
| WO | 2004018839 | A3 | 3/2004 |

* cited by examiner

METHOD AND APPARATUS FOR COMPLETING A WELL

BACKGROUND

The invention generally relates to a method and apparatus for completing a well.

When well fluid is produced from a subterranean formation, the fluid typically contains particulates, or "sand." The production of sand from the well must be controlled in order to extend the life of the well. One way to control sand production is to install screens in the well and form a substrate around the screens to filter sand from the produced well fluid. A typical sandscreen is formed from a cylindrical mesh that is generally concentric with the borehole of the well where well fluid is produced. Gravel is packed in the annular region that surrounds the sandscreen. The produced well fluid passes through the gravel, enters the sandscreen and is communicated uphole via tubing that is connected to the sandscreen.

The gravel that surrounds the sandscreen typically is introduced into the well via a gravel packing operation. In a conventional gravel packing operation, the gravel is communicated downhole via a slurry, which is a mixture of fluid and gravel. A gravel packing system in the well directs the slurry around the sandscreen so that when the fluid in the slurry disperses, gravel remains around the sandscreen.

It is not uncommon for more than one zone to be gravel packed in a well. One way to complete a well with multiple gravel pack zones is to run a sump packer first and then one packer and screen assembly with a work string and downhole service tool. The single packer is set, and then the single zone is gravel packed. Subsequently, the service tool is retrieved to the surface. This sequence is repeated until every zone is completed with gravel pack.

Another technique to complete a well with multiple gravel pack zones is to run all of the packers and screens into the well at one time with a downhole service tool. The lower zone is completed first, and the packing proceeds uphole one zone at a time. Reverse circulation typically is used to remove sand in the service tool before it moves up to the next zone. To accomplish the reverse circulation, a tool is run inside the screens to seal off the screens above the zone being packed. However, this tool typically is quite complex, as the tool must perform the sealing and routing of the slurry and returning liquid.

For purposes of preventing sand production and ultimately completion failure, it is important to achieve effective and complete gravel placement. Without a complete pack, one or more of the screens may fail. Once a screen section has failed, the produced gravel, or sand, begins flowing into the production tubing. The sand may cause erosion, may damage flow control devices in the surface equipment and may generally shorten the life of the well.

Thus, there is a continuing need for better ways to gravel pack a multiple zone well, and there is also a continuing need for better ways to allow corrective action to be taken in the event of screen failure.

SUMMARY

In an embodiment of the invention, a technique that is usable with a well includes running screen assemblies into the well on a base pipe. Each screen assembly is associated with a different zone of the well to be gravel packed. During gravel packing of the well, the screen assemblies may be selectively configured to contain pressure without running a tool inside the base pipe to form a fluid seal.

In another embodiment of the invention, a system that is usable with a well includes a base pipe, first and second screens and first and second valves. The first screen at least partially surrounds a first portion of the base pipe to create a first fluid receiving region between the first screen and the base pipe; and the second screen at least partially surrounds a second portion of the base pipe to create a second fluid receiving region between the second screen and the base pipe. The first valve controls fluid communication between the first fluid receiving region and the base pipe; and the second valve controls fluid communication between the second fluid receiving region and the base pipe. The first valve is adapted to be open to allow gravel packing near the first screen, and the second valve is adapted to be closed during the gravel packing near the first screen to isolate the central passageway from the second fluid receiving region.

In another embodiment of the invention, an apparatus that is usable with a well includes a base pipe, a screen and a valve. The base pipe has a central passageway and includes at least one radial port. The screen at least partially surrounds a portion of the base pipe to establish a fluid receiving region between the screen and the base pipe. The valve is longitudinally offset from the screen and controls fluid communication between the fluid receiving region and the central passageway.

In another embodiment of the invention, an apparatus that is usable with a well includes a base pipe, at least one isolation device, screens and valves. The isolation device(s) creates an isolated zone. The screens are located in the isolated zone, and each valve is associated with one of the screens to independently control fluid communication between an annular region that surrounds the associated screen and the central passageway.

In yet another embodiment of the invention, a technique that is usable with a well includes forming an isolated region in the well and providing screens in the isolated region. A tubular member is provided in the isolated region, and the tubular member has radial ports to receive fluid that is communicated through the screens. The technique includes selectively blocking fluid communication through at least one of the ports and allowing fluid communication through the remaining one or more ports.

Advantages and other features of the invention will become apparent from the following drawing, description and claims.

DETAILED DESCRIPTION

Figure 1:
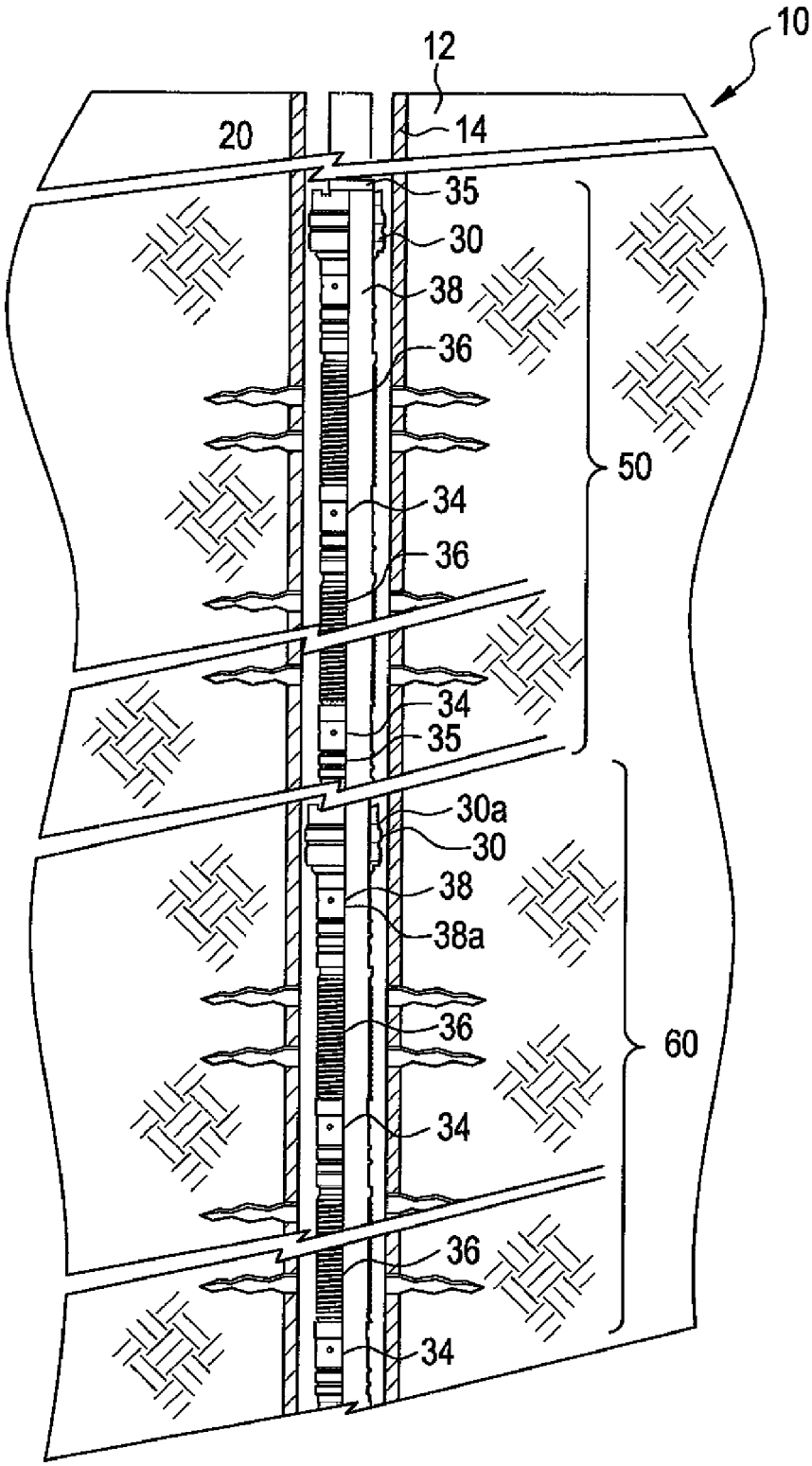
FIG. 1 is a schematic diagram of a well illustrating a gravel packing system according to an embodiment of the invention.

Referring to FIG. 1, in accordance with some embodiments of the invention, a system 10 is used for purposes of gravel packing multiple zones of a well. The system 10 is illustrated in connection with a vertical wellbore 12 that is lined by a casing string 14. However, it is noted that in accordance with other embodiments of the invention, the system 10 may be used in connection with a lateral wellbore and may be used in an uncased wellbore. Furthermore, it is noted that the system 10 may be used in connection with a subterranean or a subsea well, depending on the particular embodiment of the invention. Thus, many variations are contemplated and are within the scope of the appended claims.

The system 10 includes a tubular string 20 that extends inside the casing string 14. The string 20 includes screen assemblies, such as exemplary screen assemblies 50 and 60. It is noted that depending on the particular embodiment of the invention, the string 20 may includes additional screen assemblies.

As described herein, in accordance with embodiments of the invention, each screen assembly 50, 60 has the ability to contain pressure (i.e., form a fluid seal) to prevent fluid communication between an annular region that surrounds the screen assembly and the central passageway of the string 20. Due to this ability to form fluid isolation, an inner tool does not need to be run inside the string 20 for purposes of gravel packing multiple zones.

More particularly, in accordance with some embodiments of the invention, each screen assembly, such as the screen assemblies 50 and 60, includes an isolation device, such as a packer 30; a valve 38 to introduce a gravel packing slurry into the annular region around the screen assembly; screens 36; and valves 34, which control which screen assemblies are open or closed.

More particularly, in accordance with some embodiments of the invention, each screen 36 is associated with a particular valve 34, which may be directly located below the associated screen 36, as depicted in FIG. 1. As described further below, an annular space is created inside each screen 36 between the screen 36 and an inner base pipe of the screen assembly for purposes of forming a region to receive fluid from the surrounding annulus. Instead of flowing directly through ports in the base pipe, however, the fluid flows through the annular fluid receiving region to the associated valve 34, which is longitudinally offset from the screen 36 (below the screen 36, for example). Thus, the valve 34, depending on its state, controls whether or not fluid is communicated through its associated screen 36 and into the string's central passageway.

Thus, in accordance with some embodiments of the invention, the gravel packing via the system 10 may proceed in the following manner. First, each screen assembly is configured so that when the string 20 is first run downhole, all of the valves 34 are closed, thereby configuring all of the screen assemblies to contain pressure. As described herein, the zones (one zone per screen assembly) may thereafter be packed in a sequential manner from bottom-to-top. In other words, as each zone is packed, the fluid communication through the corresponding screen assembly is opened up between the annulus and the string's central passageway. Therefore, slurry may be introduced into the annular region of the zone through the valve 38, the slurry may then deposit corresponding sand around the screens 36 of the screen assembly, and subsequently, excess water returns through the screens 26 and to the central passageway 20.

As a more specific example, assume that the zone associated with the screen assembly 60 is being packed. For this state of the string 20, the screen assembly 50 and all screen assemblies above the assembly 50 are configured to isolate the annular region surrounding the screen assemblies from the string's central passageway. The packer 30*a* is also set, along with possibly a packer (not depicted in FIG. 1) that is located below the screen assembly 60 on the string 20. After the packer 30*a* is set, the valve 38*a* is opened for purposes of establishing communication between the central passageway 20 and the annular region that surrounds the screen assembly 60 to permit the gravel packing slurry to flow into the region being packed (i.e., the annular region that surrounds the screen assembly 60). As further described below, the opening of the valve 38*a* may trigger the opening of all of the valves 34 of the screen assembly 60 to allow excess water from the slurry flow to return through the central passageway 20.

Thus, after the packer 30*a* is set and the valves 38*a* and 34 are opened, slurry is communicated through the string 20 so that the slurry exits the valve 38 into the annular region that surrounds the screen assembly 60. Excess water returns via the screens 36.

It is noted that in accordance with some embodiments of the invention, the string 20 includes a crossover device above the valve 38 for purposes of transferring flows between the annular region and central passageway. In this regard, the slurry that flows into the well for purposes of gravel packing may, for example, flow down the annulus of the well above the screen assembly 60 and crossover above the packer 30*a* into the central passageway of the string 20. The excess water that returns from the deposited gravel may enter the screens 36, flow through the associated valves 34 and return via the central passageway of the string 20 to the crossover device. From the crossover device, the returning fluid may be communicated uphole through the central passageway of the string 20. However, in accordance with other embodiments of the invention, the returning water may be communicated to the surface via the annulus, and the slurry flow may be communicated from the surface of the well via the central passageway of the string 20. Thus, many variations are contemplated and are within the scope of the appended claims.

Figure 2:
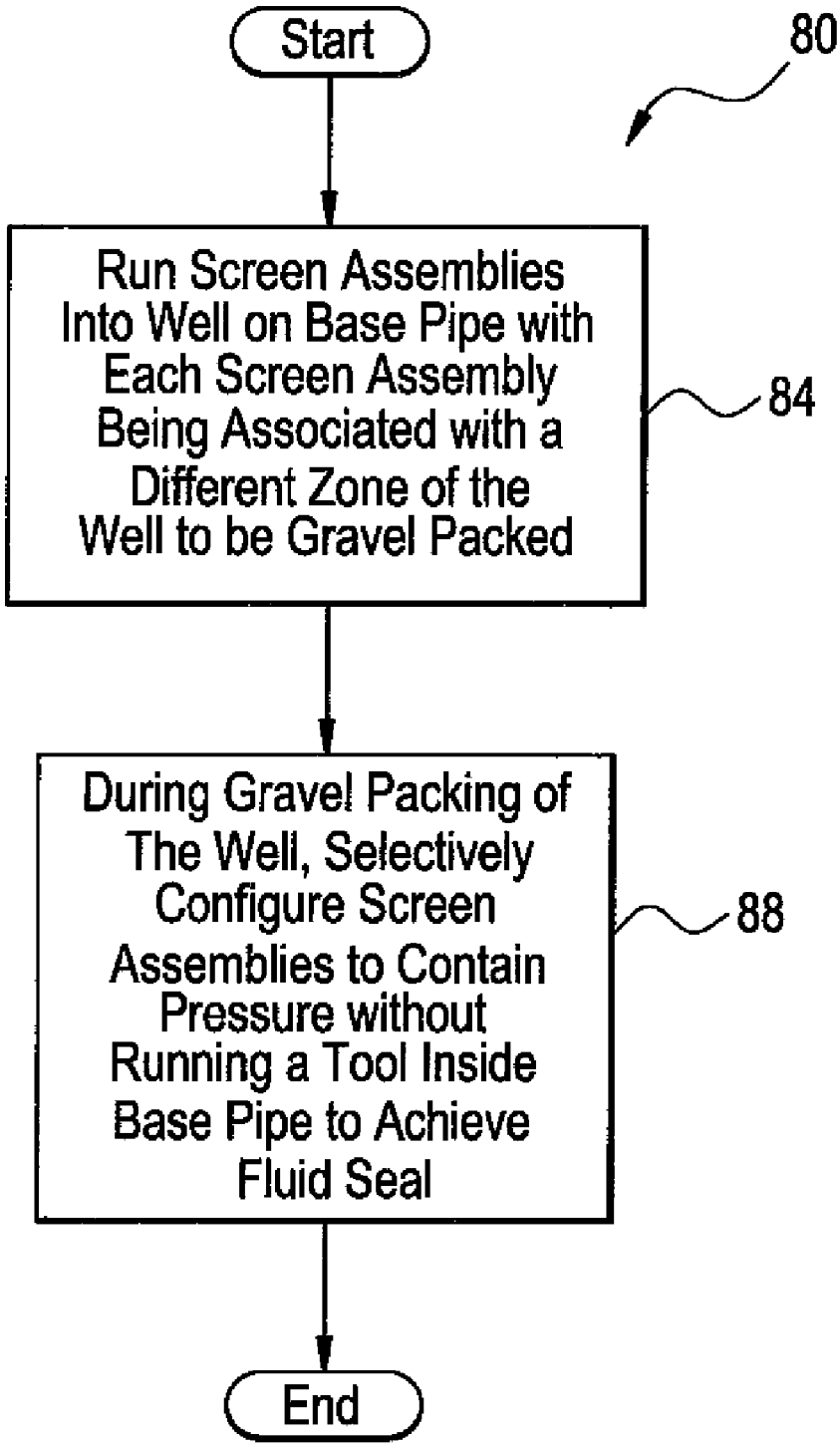
FIG. 2 is a flow diagram depicting a technique to gravel pack multiple zones in a well according to an embodiment of the invention.

To summarize, FIG. 2 depicts a technique 80 in accordance with embodiments of the invention described herein. Pursuant to the technique 80, screen assemblies are run into a well on a base pipe with each screen assembly being associated with a different zone of the well to be gravel packed, pursuant to block 84. During gravel packing of the well, the screen assemblies are selectively operated to contain pressure without running a tool inside the base pipe to achieve a fluid seal, pursuant to block 88.

Figure 3:
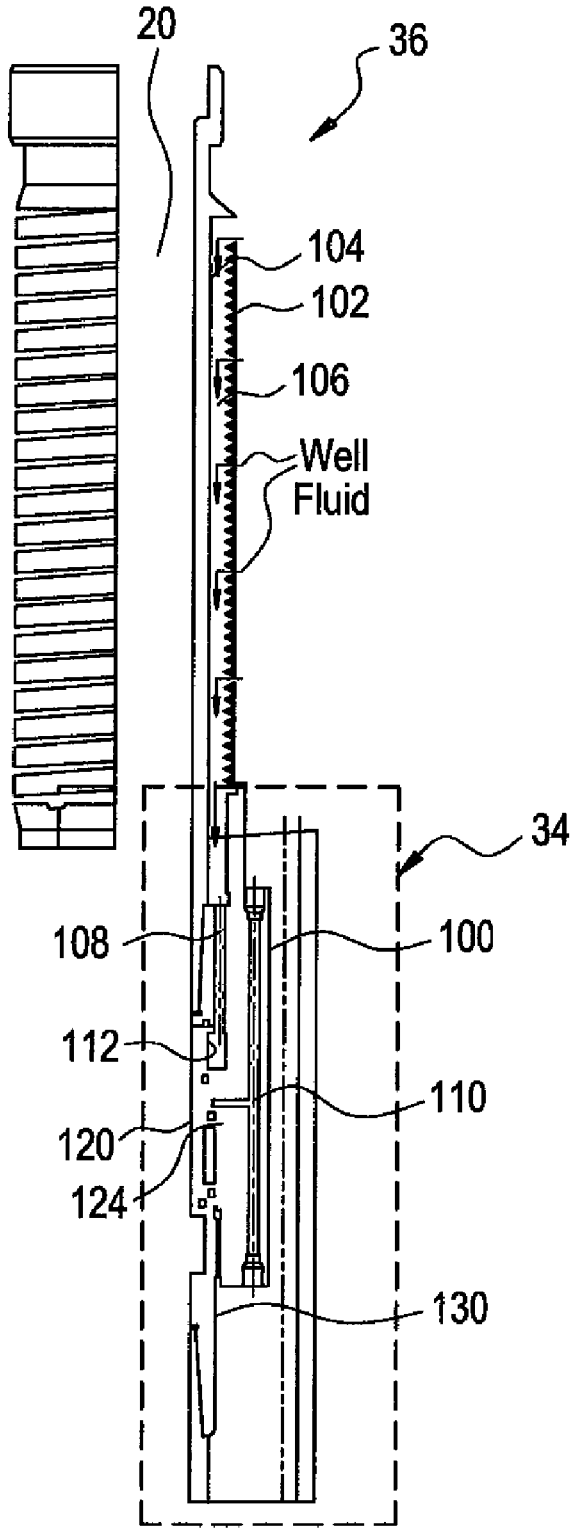
FIG. 3 is a schematic diagram of a screen and an associated fluid flow control valve of the gravel packing assembly of FIG. 1 according to an embodiment of the invention.

FIG. 3 depicts an exemplary embodiment of a screen 36 and an associated valve 34. As depicted in FIG. 3, the screen 36 is formed from a screen shroud 102 that generally surrounds a portion of a base pipe 104. The base pipe 104 forms an inner part of the string 20, and the central passageway of the base pipe 104 forms a segment of the central passageway of the string 20. A sufficient annular space exists between the screen shroud 102 and the base pipe 104 for purposes of creating a fluid receiving region 106, which receives incoming well fluid. The well fluid flows from the fluid receiving region 106 to a longitudinal passageway 108 of the valve 34. If the valve 34 is closed, which is depicted by way of example in FIG. 3, no fluid communication occurs between the fluid receiving region 106 and the central passageway of the string 20. Thus, in this state, the screen 36 contains pressure.

For purposes of controlling fluid communication between the passageways 108 and 20, the valve 34 includes a sleeve 120 that is constructed to slide longitudinally up and down for purposes of controlling flow through a radial port 112. In the position depicted in FIG. 3, the sleeve 120 closes the radial port 112 to block fluid communication between the fluid receiving region 106 and the central passageway 20.

The sleeve 120 includes a piston head 124 to which pressure may be applied for purposes of moving the sleeve 120 in a downward direction to open communication through port 112. In this regard, as depicted in FIG. 3, in accordance with some embodiments of the invention, the upper surface of the piston head 120 may be in communication with a control fluid passageway 110. Control pressure may be communicated from the surface of the well or another source (as described further below) to the passageway 110 for purposes of shifting the sleeve 120 to open the valve 34. As shown in FIG. 3, the control fluid passageway 110 may be formed in a body 100 of the valve 34, in accordance with some embodiments of the invention.

In accordance with some embodiments of the invention, the longitudinal passageway 110 may contain a flow restriction (or the valve 34 may contain another time delay mechanism) to establish a time delay in opening the valve 34. Thus, the valves 34 in a particular zone may open one at a time in a time delayed sequence (from top to bottom), in accordance with some embodiments of the invention.

The valve 34 may be opened in other ways, in accordance with other embodiments of the invention. For example, in accordance with some embodiments of the invention, the valve 34 includes a collet sleeve 130 that is positioned between a lower end of the sleeve 124 and an inner surface of the body 100. In the position depicted in FIG. 3, the collet sleeve 130 maintains the closed position of the sleeve 120. However, the exertion of pressure via the control fluid passageway 110 causes the sleeve 120 to move downwardly and open the port 112. Likewise, the collet sleeve 130 may be actuated, such as by a shifting tool, for example, for purposes of allowing the sleeve 120 to move downwardly to open the port 112.

Figure 4:
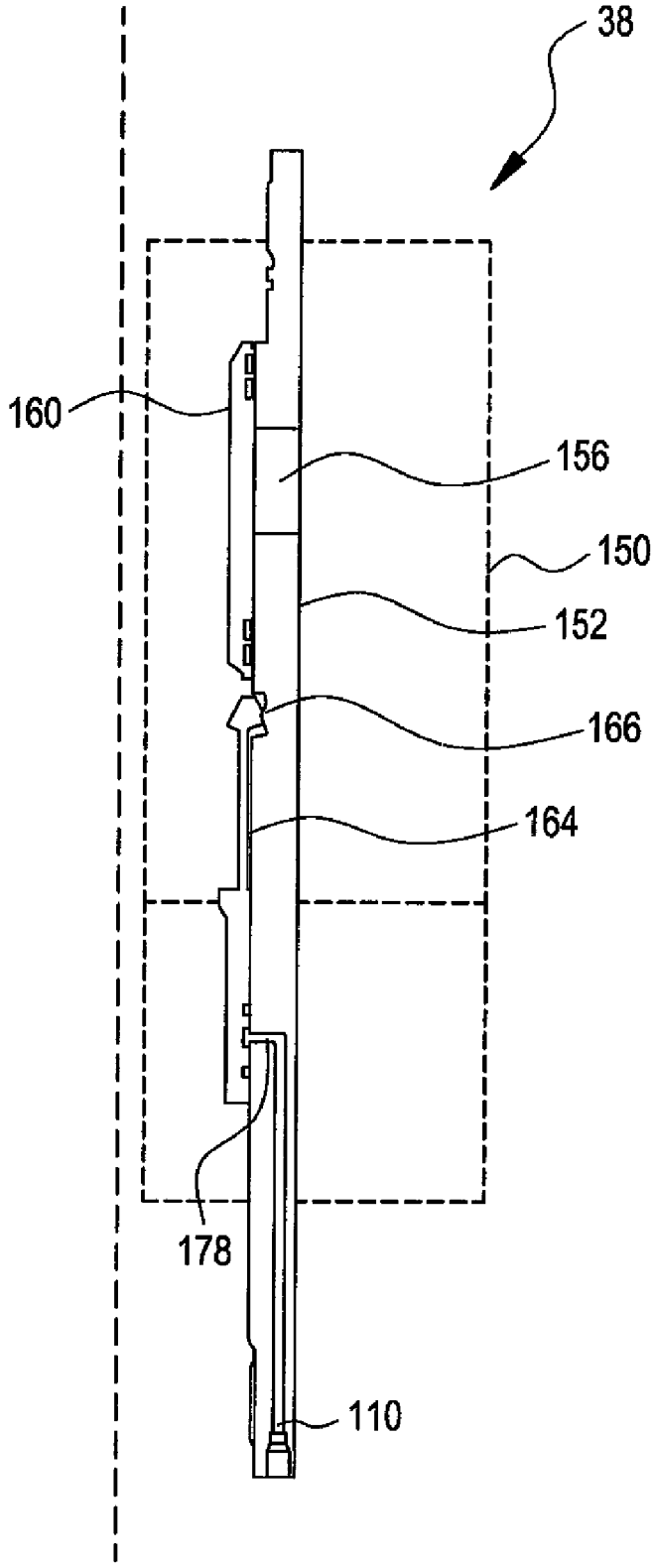
FIG. 4 is a schematic diagram of a valve of the gravel packing assembly of FIG. 1 according to an embodiment of the invention.

In accordance with some embodiments of the invention, the communication of pressure to the hydraulic control line 110 may be controlled by the action of the valve 38. For example, referring to FIG. 4, in accordance with some embodiments of the invention, the valve 38 may include a sleeve 178 that controls the communication of fluid pressure to the hydraulic fluid passageway 110. More particularly, the valve 38, in accordance with some embodiments of the invention, includes a sleeve 160 that is actuated for purposes of opening communication through a radial port 156 to establish fluid communication between the annular region that surrounds the valve 38 and the central passageway of the string 20. The sleeve 160, when moved downwardly to open communication through the port 156, contacts an upper end of the sleeve 178, which may include collet fingers that reside inside an annular slot 166. When the sleeve 160 moves downwardly, the collet fingers are dislodged from the slot 166, and the sleeve 178 moves downwardly to establish communication between the passageway 110 and the central passageway of the string 20.

It is noted that the valves 34 and 38 are merely examples of possible embodiments of the invention, as other valve designs are contemplated and are within the scope of the appended claims. For example, the valve 36 may be a variable position valve, in accordance with other embodiments of the invention, in which the valve 36 has multiple open positions to provide controllable throttling, or choking, of the well fluid flow.

The screens 36 remain open after gravel packing for purposes of receiving well fluid. In the embodiments described above, the screens 36 of a particular screen assembly all open or close together. However, in other embodiments of the invention, the screens 36 of a particular screen assembly are individually controllable, which allows a screen through which sand is being produced to be closed without shutting off production along the entire screen assembly.

Therefore, in accordance with embodiments of the invention described herein, individual screens of a screen assembly may be selectively closed during production from the well for purposes of isolating a section that has not been adequately packed. The specific screen or screens that are inadequately packed may be determined by an operator at the surface of the well through, for example, an iterative process in which screens are opened and closed for purposes of evaluating which screens are producing sand. Once the screen or screens have been identified that are causing the sand production, the screens may then be closed (through action(s) by the operator) to allow production from the rest of the zone.

Figure 5:
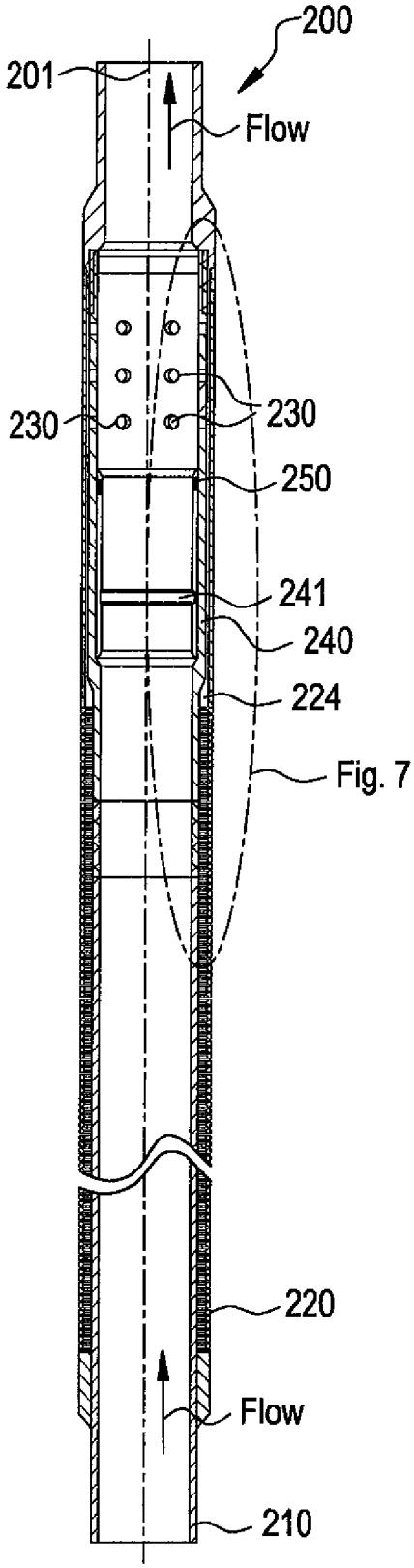
FIG. 5 is a schematic diagram of a screen section when open according to an embodiment of the invention.

FIG. 5 generally depicts a screen section 200 in accordance with some embodiments of the invention. An associated screen assembly in the well may include a plurality of the screen sections 200. The screen section 200 illustrates a valve that may be used in connection with a particular screen shroud 220 for purposes of controlling the flow of well fluid through the shroud screen 220. This control is independent from the flow control associated with the other screens of the screen assembly.

In the example depicted in FIG. 5, the screen 200 surrounds a portion of a base pipe 210, which forms a segment of a production string. Thus, when the shroud screen 220 is receiving a well fluid flow, well fluid flows into the screen shroud 220 and passes through radial ports 230 of the base pipe 210 toward the surface of the well.

The screen section 200 includes a sleeve 240, which forms the fluid control element of a valve for the section 200. In particular, the sleeve 240 is located inside of and is coaxial (i.e., shares the same longitudinal axis 201) with the base pipe 210. The sleeve 240 may be located above the screen 220 (in the example depicted in FIG. 5), and the position of the valve 240 controls whether flow occurs through the radial ports 230 (as depicted in FIG. 5 in an open state of the valve) or whether fluid communication is blocked through the ports 230 in a closed position of the valve, as depicted in FIG. 6.

Figure 6:
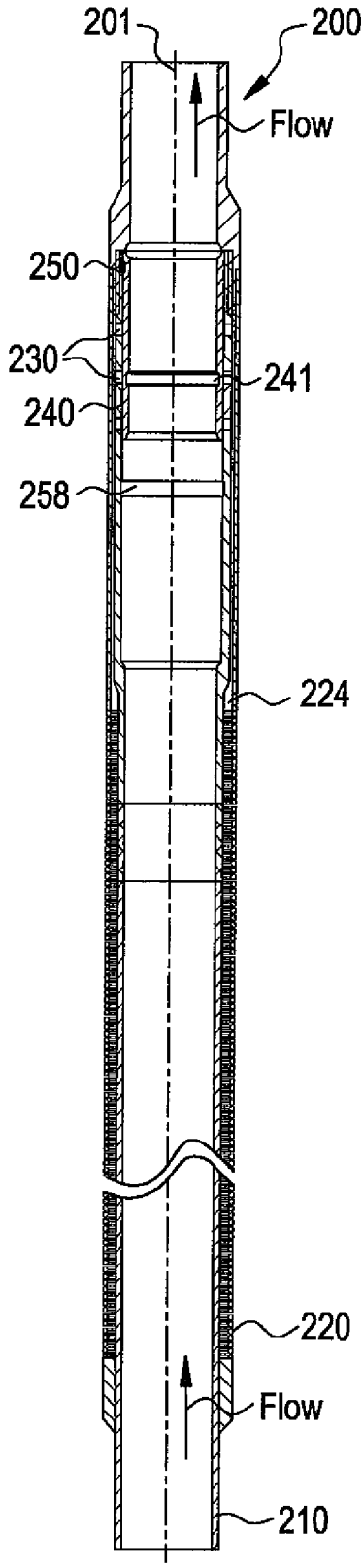
FIG. 6 is a schematic diagram of the screen section when closed according to an embodiment of the invention.
Figure 7:
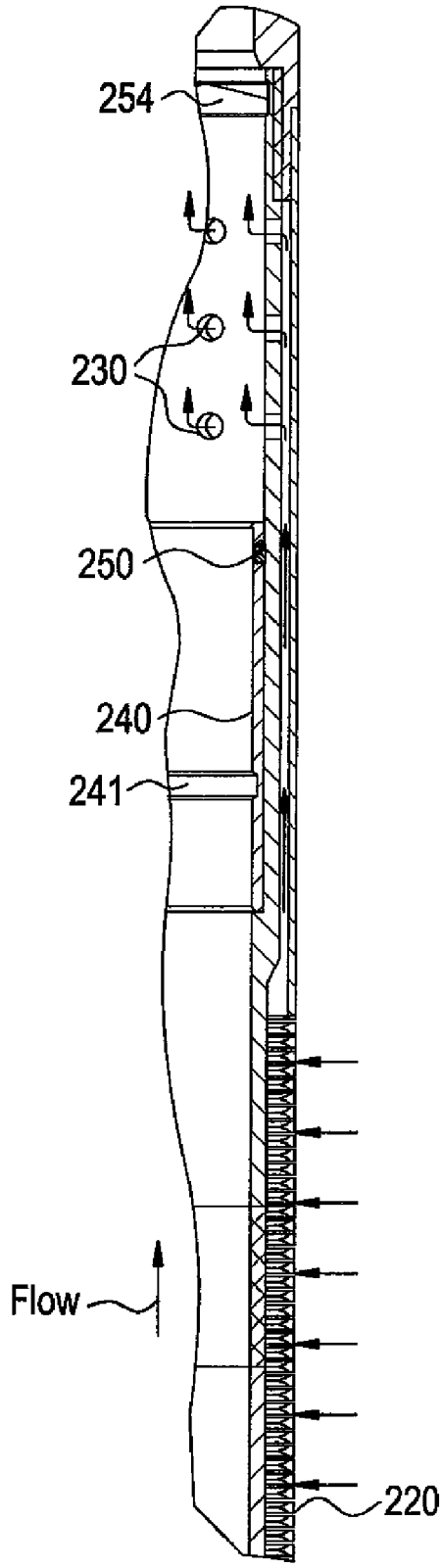
FIG. 7 is an enlarged view of the screen section of FIG. 5 according to an embodiment of the invention.

Still referring to FIG. 5, near its upper end, the sleeve 240 is connected to a snap ring 250 that locks the sleeve 240 either in the open position (FIG. 5) or the closed position (see FIG. 6). FIG. 7 depicts a more detailed view of the sleeve 240 and its associated components, when the sleeve 240 is in its lower open position, as depicted in FIG. 5. The snap ring 250 resides in an outer annular groove of the sleeve 240 and snaps into an inner annular groove 258 (see FIG. 6) of the base pipe 210, when the valve is open. Conversely, when the sleeve 240 is in its upmost position to close the valve (the state depicted in FIG. 6), the snap ring 250 snaps into an inner annular groove 254 (see FIG. 5) of the base pipe 210. After the snap ring 250 is in the appropriate groove 254, 258, the sleeve 240 is "locked" into position.

For purposes of changing the state of the valve, a shifting tool may be run into the central passageway of the string and base pipe 210 for purposes of engaging an inner profile 241 of the sleeve 240. Thus, upon engagement of the profile 241, the movement of the shifting tool may be used to move the sleeve 240 to the appropriate position to open or close the valve.

Figure 8:
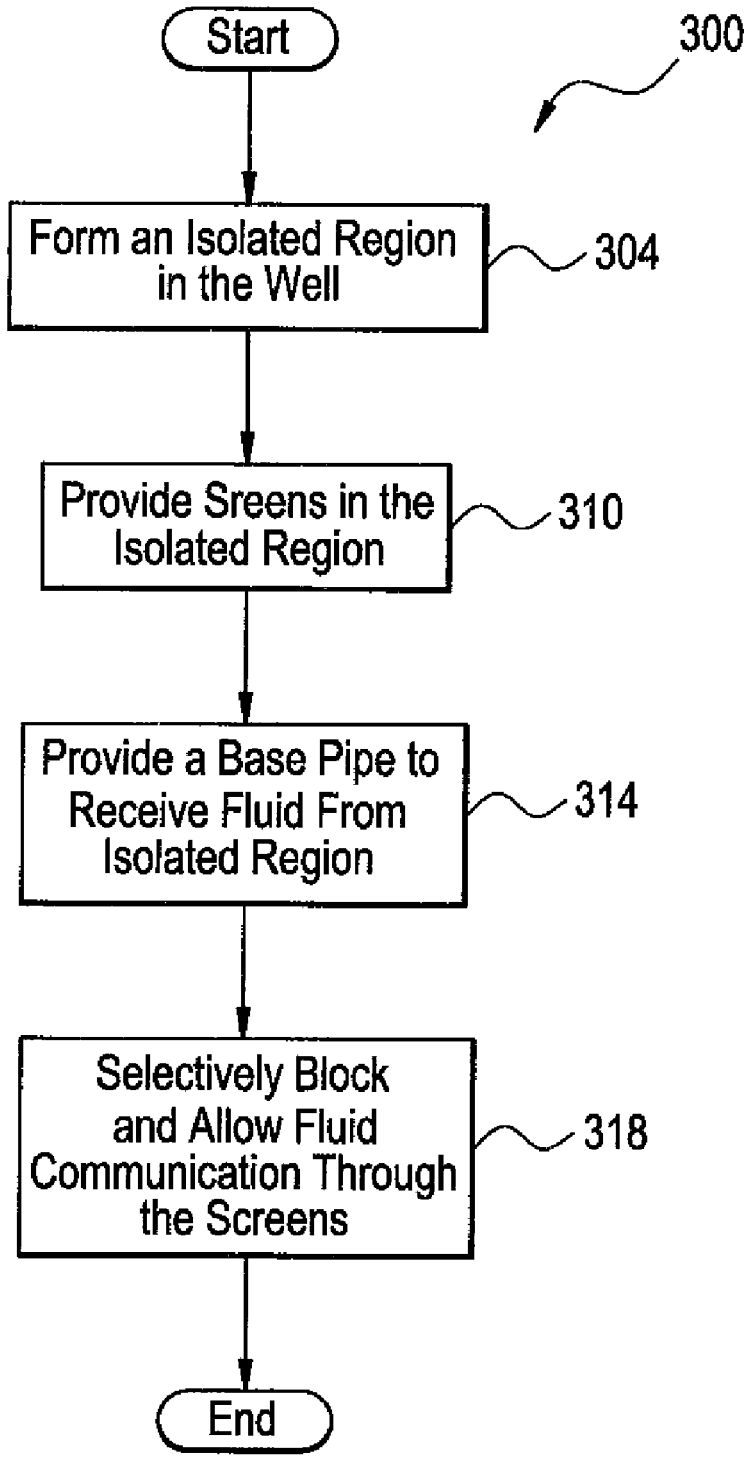
FIG. 8 is a flow diagram illustrating a technique to prevent sand production on a screen-by-screen basis according to an embodiment of the invention.

Referring to FIG. 8, to summarize, in accordance with embodiments of the invention described herein, a technique 300 may be used for purposes of isolating certain screens in a zone to minimize sand production. Pursuant to the technique 300, an isolated region (i.e., a production zone) is formed in the well, pursuant to block 304 and screens are provided in the isolated region, pursuant to block 310. Next, a base pipe is provided (block 314) to receive fluid from the isolated region, and fluid communication through the screens is selectively blocked and allowed (block 318) for purposes of targeting screens that allow excessive sand production and allowing the screens to produce that do not.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

a base pipe comprising a central passageway, a first radial port and a second radial port;

a first screen to at least partially surround a first portion of the base pipe to create a first fluid receiving region between the first screen and the base pipe;

a second screen to at least partially surround a second portion of the base pipe to create a second fluid receiving region between the second screen and the base pipe;

a first valve to control fluid communication between the first fluid receiving region and the base pipe;

a second valve to control fluid communication between the second fluid receiving region and the base pipe;

a valve control communication path adapted to communicate a stimulus to the first and second valves to cause the first valve to transition from a closed state to an open state and cause the second valve to transition from a closed state to an open state in response to the stimulus; and a delay element disposed in the communication path to delay communication of the stimulus to the second valve to cause the first and second valves to operate in a time delayed sequence in response to the stimulus being introduced to the valve control communication path, wherein the first screen, the second screen, the valve control communication path and the base pipe are adapted to be run downhole as a unit.

2. The system of claim 1, further comprising:

packers adapted to be set to create an isolated zone containing the first and second screens.

3. The system of claim 1, wherein the time delay element comprises a flow restriction.

4. The system of claim 1, wherein the valve control communication path comprises a control line adapted to communicate fluid, and the stimulus comprises a fluid pressure.

5. A method usable with a well, comprising:

running a string into the well, the string comprising screen assemblies, valves and a base pipe, wherein each screen assembly comprises a screen that surrounds a different section of the base pipe to create a fluid receiving region between the screen and the base pipe, and each valve being associated with a different screen assembly to independently control fluid communication between one of the fluid receiving regions and the base pipe;

communicating a gravel packing slurry into the well;

communicating a control stimulus downhole, the communication of the control stimulus being separate from the communication of the gravel packing slurry; and downhole in the well, serially communicating the stimulus to the first and second valves and regulating the serial communication to regulate receipt of the stimulus by the first and second valves to cause the first and second valves to open in an ordered sequence via a delay element disposed in a communication path that delays communication of the stimulus to the second valve in response to the stimulus being communicated downhole.

6. The method of claim 5, wherein the act of communicating the control stimulus downhole comprises communicating fluid pressure using a control line.

7. The method of claim 5, wherein the act of regulating receipt of the stimulus comprises delaying the stimulus downhole in the well.

8. A system usable with a well, comprising:

a base pipe;

a screen to at least partially surround a first portion of the base pipe to create a fluid receiving region between the screen and the base pipe;

a first valve responsive to fluid pressure at a control port of the first valve to control fluid communication between the fluid receiving region and the base pipe;

a second valve adapted to be selectively opened to control communication of gravel slurry between a central passageway of the base pipe and an annular region surrounding the base pipe; and a third valve adapted to be run downhole as part of the unit, the third valve being adapted to sense opening of the second valve and respond to the sensing to expose the control port of the first valve to pressure to open the first valve.

9. The system of claim 8, wherein the third valve is adapted to mechanically sense opening of the second valve.

10. The system of claim 8, wherein the third valve comprises a sleeve adapted to translate in response to the translation of a sleeve of the second valve.

11. The system of claim 8, wherein the second valve is adapted to communicate a gravel packing slurry comprising gravel and a fluid such that the screen filters out the gravel, and the fluid without the gravel is communicated through the screen and through the first valve.

* * * * *